US007074054B2

(12) United States Patent
Mertz et al.

(10) Patent No.: US 7,074,054 B2
(45) Date of Patent: Jul. 11, 2006

(54) SMT TERMINAL BLOCK

(75) Inventors: John C. Mertz, Maple Grove, MN (US); Cory L. Grabinger, Maple Grove, MN (US); Dennis R. Grabowski, Champlin, MN (US); Arthur J. Punyko, St. Paul, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/913,273

(22) Filed: Aug. 6, 2004

(65) Prior Publication Data

US 2006/0030207 A1 Feb. 9, 2006

(51) Int. Cl.
*H01R 12/00* (2006.01)

(52) U.S. Cl. ..... 439/78

(58) Field of Classification Search ..... 439/78, 439/83, 74, 855, 554, 552–558, 65, 412, 439/425, 709

See application file for complete search history.

(56) References Cited

U.S. PATENT DOCUMENTS

| | | | | |
|---|---|---|---|---|
| 3,937,553 | A * | 2/1976 | Maximoff et al. | 439/853 |
| 4,959,750 | A | 9/1990 | Cnyrim et al. | |
| 5,017,164 | A | 5/1991 | Gibbs | |
| 5,112,245 | A * | 5/1992 | Shimirak et al. | 439/412 |
| 5,200,884 | A | 4/1993 | Ohashi | |
| 5,616,047 | A * | 4/1997 | Lutsch | 439/397 |
| 5,631,807 | A | 5/1997 | Griffin | |
| 5,662,499 | A * | 9/1997 | Strack et al. | 439/709 |
| 5,675,888 | A | 10/1997 | Owen et al. | |
| 5,685,726 | A * | 11/1997 | Lwee et al. | 439/83 |
| 5,928,031 | A | 7/1999 | Chishima | |
| 5,943,216 | A | 8/1999 | Schmidt | |
| 6,031,726 | A | 2/2000 | Vinciarelli et al. | |
| 6,146,212 | A * | 11/2000 | Kipnik | 439/709 |
| 6,239,977 | B1 | 5/2001 | Price et al. | |
| 6,244,883 | B1 * | 6/2001 | Ito et al. | 439/247 |
| 6,287,130 | B1 * | 9/2001 | Torii | 439/83 |
| 6,623,281 | B1 | 9/2003 | Vinciarelli et al. | |
| 2002/0002012 | A1 | 1/2002 | Torii | |
| 2002/0076979 | A1 | 6/2002 | Terauchi et al. | |
| 2003/0197264 | A1 | 10/2003 | Neild et al. | |
| 2005/0026463 | A1 * | 2/2005 | Harris et al. | 439/65 |

OTHER PUBLICATIONS http://www.automationtechies.com/store/pid10235.php, Phoenix Contact Introduces a High Temperature SMIT-Compatible Terminal Block-Auto . . . , 2 pages, printed Apr. 28, 2004.

(Continued)

*Primary Examiner*—Gary Paumen
*Assistant Examiner*—Phuongchi Nguyen
(74) *Attorney, Agent, or Firm*—Gregory M. Ansems

(57) ABSTRACT

Terminal blocks adapted for placement on a printed circuit board using SMT techniques are disclosed herein. A terminal block in accordance with an illustrative embodiment of the present invention can include a main body, a terminal block header including a number of terminal inlet ports configured to receive wire or conduit, and one or more terminal leads adapted to make electrical contact with a number of attachment pads formed on the printed circuit board. An illustrative method of mounting the terminal block to a printed circuit board may include the steps inserting the upper portion of the main body through a terminal block opening, and then connecting the one or more terminal leads of the terminal block to attachment pads.

51 Claims, 9 Drawing Sheets

OTHER PUBLICATIONS http://eshop.phoenixcontact.com/phoenix/produktstrukur, EMKDS Press-In Printed Circuit Terminal Blocks, 1 page, printed Apr. 28, 2004.
http://eshop.phoenixcontact.com/phoenix/produktstruktur, Multi-Position Printed Circuit Termination Blocks, Pitch 3.81 mm, 1 page, printed Apr. 28, 2004.
Phoenix Contact GmbH & Co. KG, MKDS 1/2-3,81 SMD BK, General data, pp. 1-5, Apr. 28, 2004.
Phoenix Contact GmbH & Co. KG, MKDS 1/3-3,81 SMD BK, General data, pp. 1-5, Apr. 28, 2004.
WECO General Catalog No. 199, Electrical and Electronic Terminal Blocks and Modules, pp. 72-78, Jan. 1999.

* cited by examiner

SMT TERMINAL BLOCK

FIELD

The present invention relates generally to the field of connection terminals for printed circuit boards. More specifically, the present invention pertains to terminal blocks or the like having terminal leads for connection to a printed circuit board using surface mount technology (SMT).

BACKGROUND

Terminal blocks are used in a number of electronic systems for connecting wires, conduit, jumpers, shunts, board-to-board cables, and/or other such components to a printed circuit board. In the fabrication of HVAC controllers, for example, terminal blocks are often used to permit an installer to quickly connect wires or other components to an internal circuit board, reducing the time necessary to install an HVAC system. Such devices typically include a terminal block header equipped with a number of inlet ports that can be configured to receive wire or conduit. In certain designs, the wire or conduit can be secured to the terminal block using a screw, spring clamp, quick connect, insulation displacement connection (IDC) terminal, or other suitable fastening means. The terminal block may include a number of terminal leads or posts that can be used to electrically connect the inserted wires or conduit to attachment pads formed on the printed circuit board. The configuration of the terminal leads will typically vary depending on how the terminal block is to be mounted to the printed circuit board. If, for example, the terminal block is designed for mounting to the printed circuit board using through-hole technology (THT), the terminal leads or posts will typically have a straight configuration at their ends, although other variations do exist.

Due to their relatively large size and strength requirements, terminal blocks are typically mounted to printed circuit boards using conventional mounting techniques such as THT or wave soldering, where the terminal leads or posts are inserted through several small holes formed in the printed circuit board and then soldered in place either manually by hand or with the aid of automation equipment. A more efficient way to mount components to the printed circuit board uses surface mount technology (SMT). In SMT, components are typically mounted by soldering the component leads or terminals to attachment pads formed on the top surface of the printed circuit board. Prior to mounting, a solder paste is applied to selective portions of the printed board in a pattern corresponding generally to the attachment pads of the components. Once applied, the components are then placed onto the surface of the printed circuit board and soldered in place by applying heat. A cleaning step may then be performed on the surface of the printed circuit board to clean the lead contacts, if necessary.

While the use of SMT components is becoming increasingly popular in the art, the connection of terminal blocks using SMT still remains a significant obstacle in the manufacturing and assembly of many electronic devices. In some cases, the relatively large size of the terminal block in comparison to other SMT components may prevent the terminal block from being mounted to the printed circuit board using automated SMT techniques, thus requiring more costly hand placement methods. In addition, the force requirements that the terminal block must sustain during use may also limit the use of certain SMT techniques. As a result, the terminal blocks are often mounted to the printed circuit board subsequent to surface mounting of the other components, requiring additional manufacturing steps and/or cost. With some terminal blocks, this means manually mounting the terminal block to the printed circuit board using THT or other such methods, requiring the formation of custom footprints, hole diameters, and complicated reflow curves that can increase manufacturing time and decrease quality.

Moreover, since the terminal blocks are typically mounted on the same side of the printed circuit board as the other SMT components, there is an increased risk of electrostatic discharge and/or mechanical damage to the sensitive SMT components. For example, in some cases the use of a screwdriver or other such tool to connect the wires to the terminal block can result in undesired contact with the other components, sometimes causing damage to the printed circuit board or other components. Labeling of the terminal block may also be limited in certain cases since the other SMT components may occupy space that would normally be used for screen-printing labels on the printed circuit board.

SUMMARY

The present invention pertains to terminal blocks having terminal leads for connection to a printed circuit board using SMT. A terminal block in accordance with an illustrative embodiment of the present invention can include a main body, a terminal block header including a number of inlet ports configured to receive wire or other conduit, and one or more terminal leads adapted to make electrical contact with a number of attachment pads formed on the printed circuit board. The terminal leads may extend outwardly at an angle from one or more sides and/or ends of the main body, and can be configured to mount to the attachment pads using SMT. In certain embodiments, for example, the terminal leads may have a configuration wherein a portion of each terminal lead bends and orients in a direction parallel with the component-side surface of the printed circuit board.

An illustrative method of surface mounting a terminal block to a printed circuit board having a first side, a second side, and a terminal block opening extending from the first side to the second side may include the steps of inserting an upper portion of the main body through the terminal block opening and advancing a portion of the terminal block above the second side of the printed circuit board, and then connecting one or more terminal leads of the terminal block to attachment pads formed on the first side of the printed circuit board. The terminal leads can be configured to surface mount to the first side of the printed circuit board in a manner that mechanically supports the terminal block within the terminal block opening. A number of detents, bendable tabs, expandable members, fitting nails, and/or other suitable structural elements can be used in conjunction with the terminal leads and/or a number of flanges to secure the terminal block to the printed circuit board. In certain embodiments, a flat placement pad can be provided on the base portion of the main body to facilitate attachment of the terminal block to the printed circuit board using automated SMT techniques, if desired.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

Figure 1:
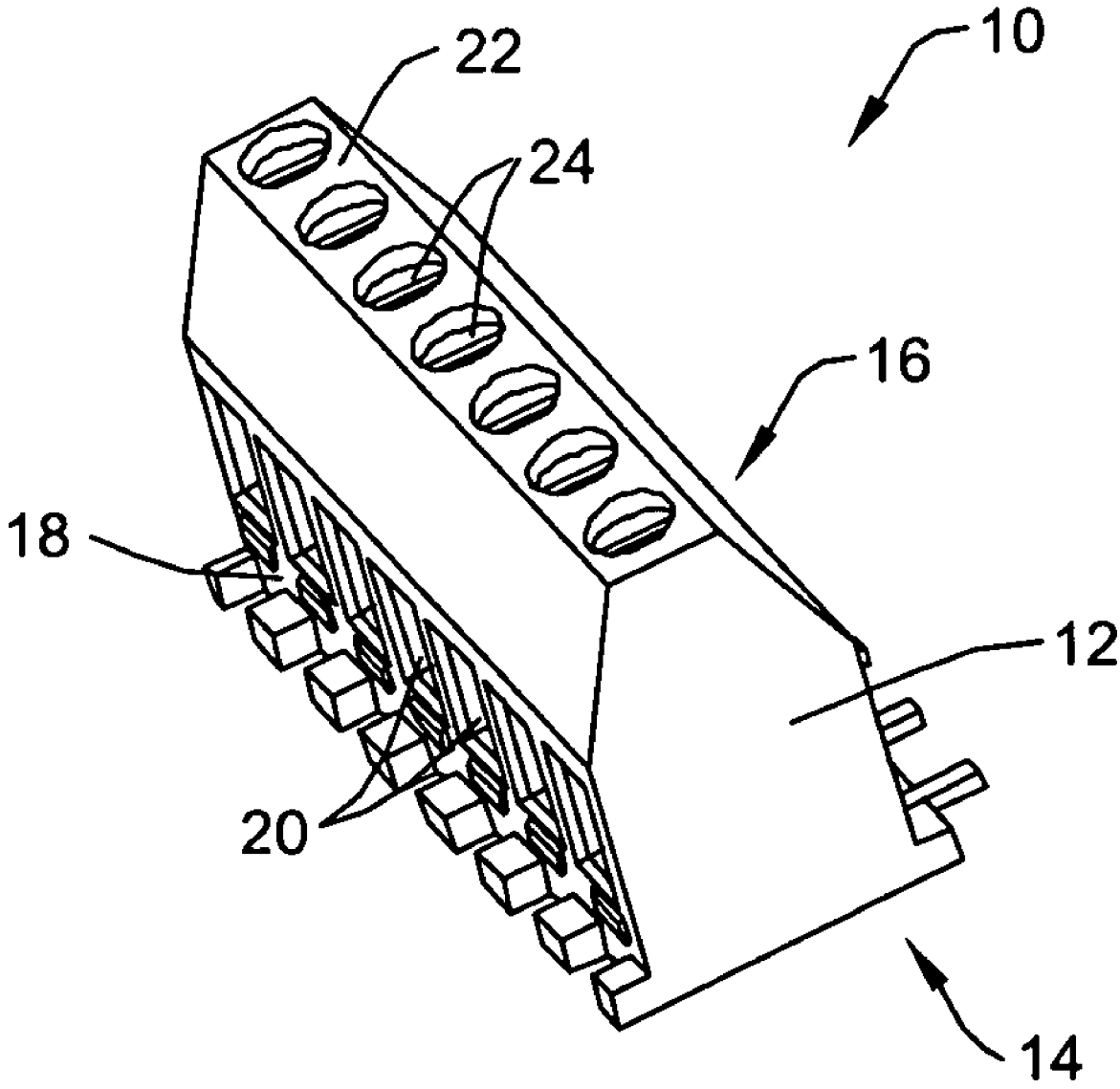
FIG. 1 is a top perspective view of a terminal block in accordance with an illustrative embodiment of the present invention.

FIG. 1 is a top perspective view of an SMT terminal block 10 in accordance with an illustrative embodiment of the present invention. As shown in FIG. 1, terminal block 10, illustratively a Euro-style terminal block, can include a main body 12 having a base portion 14 and an upper portion 16. The main body 12 can include a terminal inlet header 18 equipped with a number of inlet ports 20 that can be each configured to receive a wire, conduit, jumper, shunt, or other desired member. The illustrative terminal block 10 can also include an upper header 22 equipped with a number of screws 24 that can be used to secure the inserted wire or conduit to the terminal block 10. Although screws 24 are specifically depicted in the illustrative embodiment of FIG. 1, it should be understood that other suitable fasteners such as spring clamps, quick connects, and/or IDC terminals can also be employed, if desired.

The terminal inlet header 18 can be configured to accept the wire or conduit in any number of desired orientations. In the illustrative embodiment of FIG. 1, for example, the terminal inlet header 18 is oriented such that wire entry into the inlet ports 20 is accomplished from a horizontal position (i.e. parallel to the surface of the printed circuit board). It should be understood, however, that the terminal inlet header 18 could be configured to accept wire or conduit from a vertical or diagonal position, if desired. Moreover, while the terminal block 10 depicted in FIG. 1 is configured to accept wire or conduit from a single side of the terminal block 10, other embodiments have been envisioned wherein the terminal inlet header 18 permits wire entry from multiple sides and/or ends of the terminal block 10, if desired.

Figure 2:
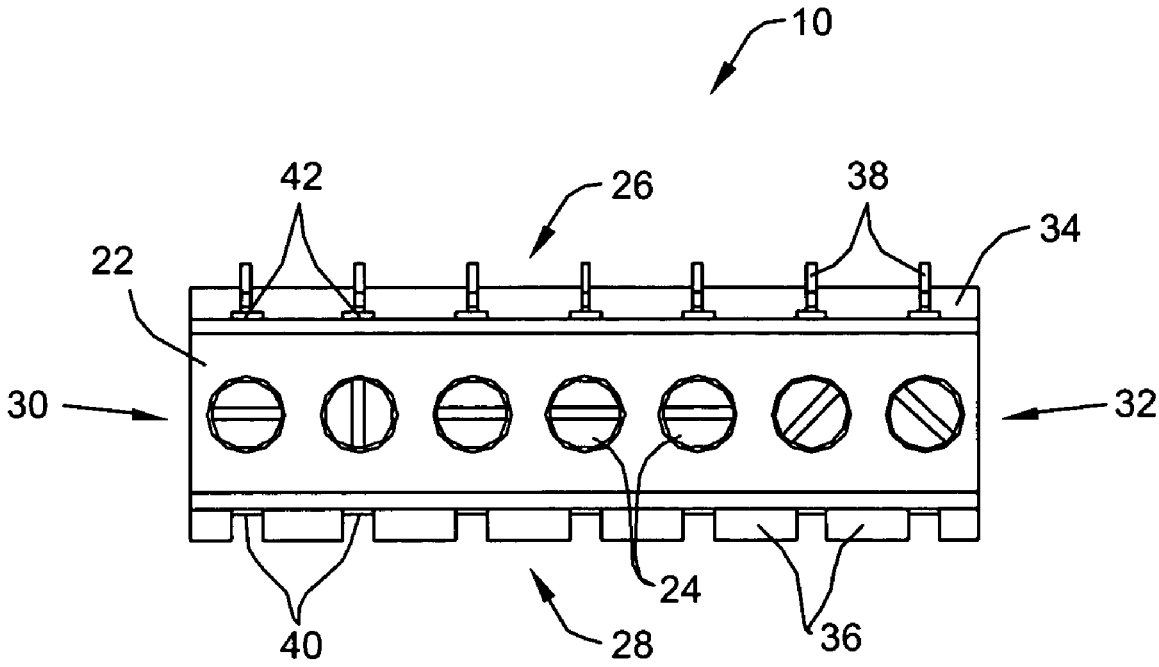
FIG. 2 is a top view of the illustrative terminal block of FIG. 1.

FIG. 2 is a top view of the illustrative terminal block 10 of FIG. 1. As can be seen in FIG. 2, the main body 12 of the terminal block 10 may further define a first side 26, a second side 28, a first end 30, and a second end 32. A first flange 34 extending outwardly at an angle perpendicular to the first side 26 of the main body 12 can be configured to lie flush against the component side of a printed circuit board or the like, securing the first side 26 of the main body 12 thereto. In like fashion, a second flange 36 extending outwardly at an angle perpendicular to the second side 28 of the main body 12 can be similarly configured to lie flush against the component side of the printed circuit board, securing the second side 28 of the main body 12 thereto. In the illustrative embodiment depicted in FIG. 2, the first flange 34 is shown spanning the entire length of the first side 26 whereas the second flange 36 is shown as having a number of discrete flanges disposed along the length of the second side 28. It should be understood, however, that the flanges 34,36 can assume other configurations, if desired, and, in some embodiments, may not be included at all. If desired, other elements such as fitting nails may also be provided on the ends 30,32 and/or sides 26,28 of the terminal block 10.

A number of terminal leads 38 extending outwardly at an angle from the first side 26 of the main body 12 can be configured to electrically connect the inlet ports 20 to a number of attachment pads formed on the printed circuit board. The terminal leads 38 can be formed from a suitably conductive material that can be soldered onto the surface of the printed circuit board using SMT techniques. In certain embodiments, for example, the terminal leads 38 can be formed from tin-plated bronze, nickel-plated brass, gold, platinum, or other suitable material used in the art. In addition to electrically connecting the inlet ports 20 to the attachment pads, the terminal leads 38 may further act to mechanically support the terminal block 10 to the printed circuit board, either in addition to or in lieu of the aforementioned flanges 34,36.

Figure 3:
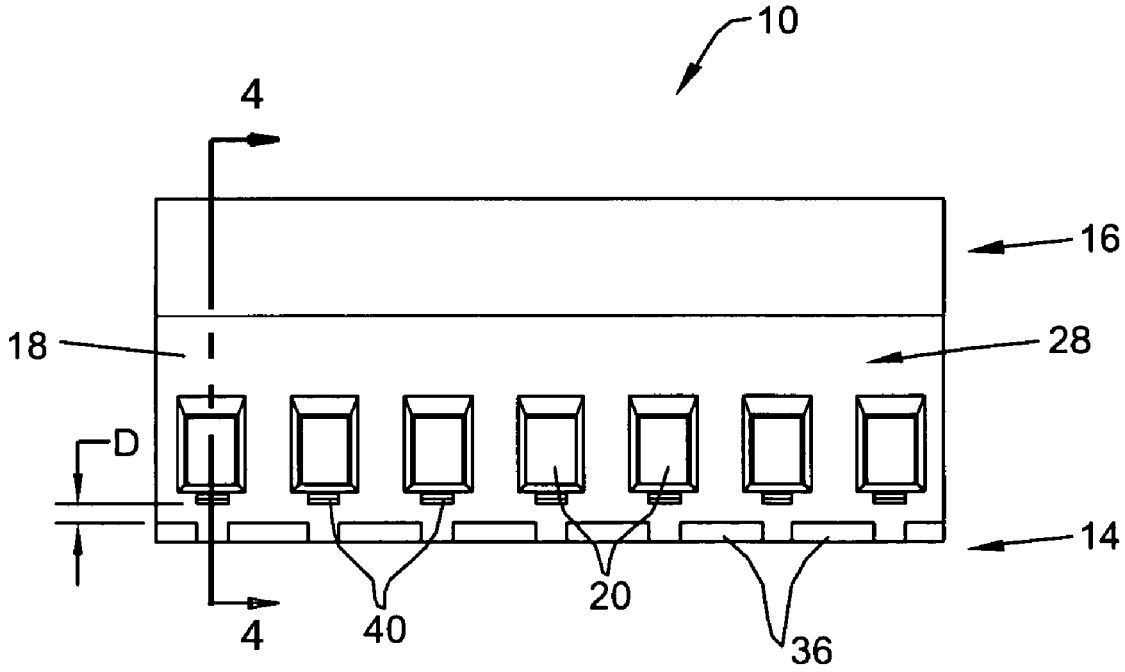
FIG. 3 is a side view of the terminal block of FIG. 1.

FIG. 3 is a side view showing the second side 28 of the terminal block 10 in greater detail. As can be seen in FIG. 3, each of the inlet ports 20 may define an opening allowing the installer to insert a wire or conduit into the terminal block 10 from a substantially horizontal position. The dimensions of the inlet ports 20 as well as the spacing between each adjacent inlet port 20 can be varied to permit wire or conduit of varying size to be inserted into the terminal block 10. In some embodiments, the wire entry of the inlet port 20 can also be chamfered slightly to facilitate insertion of the wire or conduit, if desired.

A number of detents 40 located below each of the inlet ports 20 can be used to further secure or support the terminal block 10 to the surface of the printed circuit board, if desired. As shown in FIG. 3, the detents 40 can be spaced apart from the second flange 36 a sufficient distance D to permit the second side 28 of the terminal block 10 to snap-fit onto the thickness of the printed circuit board. A similar set of detents 42 (see FIG. 2) located on the first side 26 of the main body 12 and spaced apart from the first flange 34 a similar distance can be used to secure the first side 26 of the terminal block 10 to the printed circuit board in like fashion, if desired. In certain embodiments, the distance D between each detent 40,42 and respective flange 34,36 may correspond generally to the thickness of a single-layer printed circuit board. The distance D can be altered, however, to permit the terminal block 10 to be secured onto other sized printed circuit boards (e.g. multi-layer printed circuit boards), or to permit the terminal block 10 to be secured to other desired components.

Figure 4:
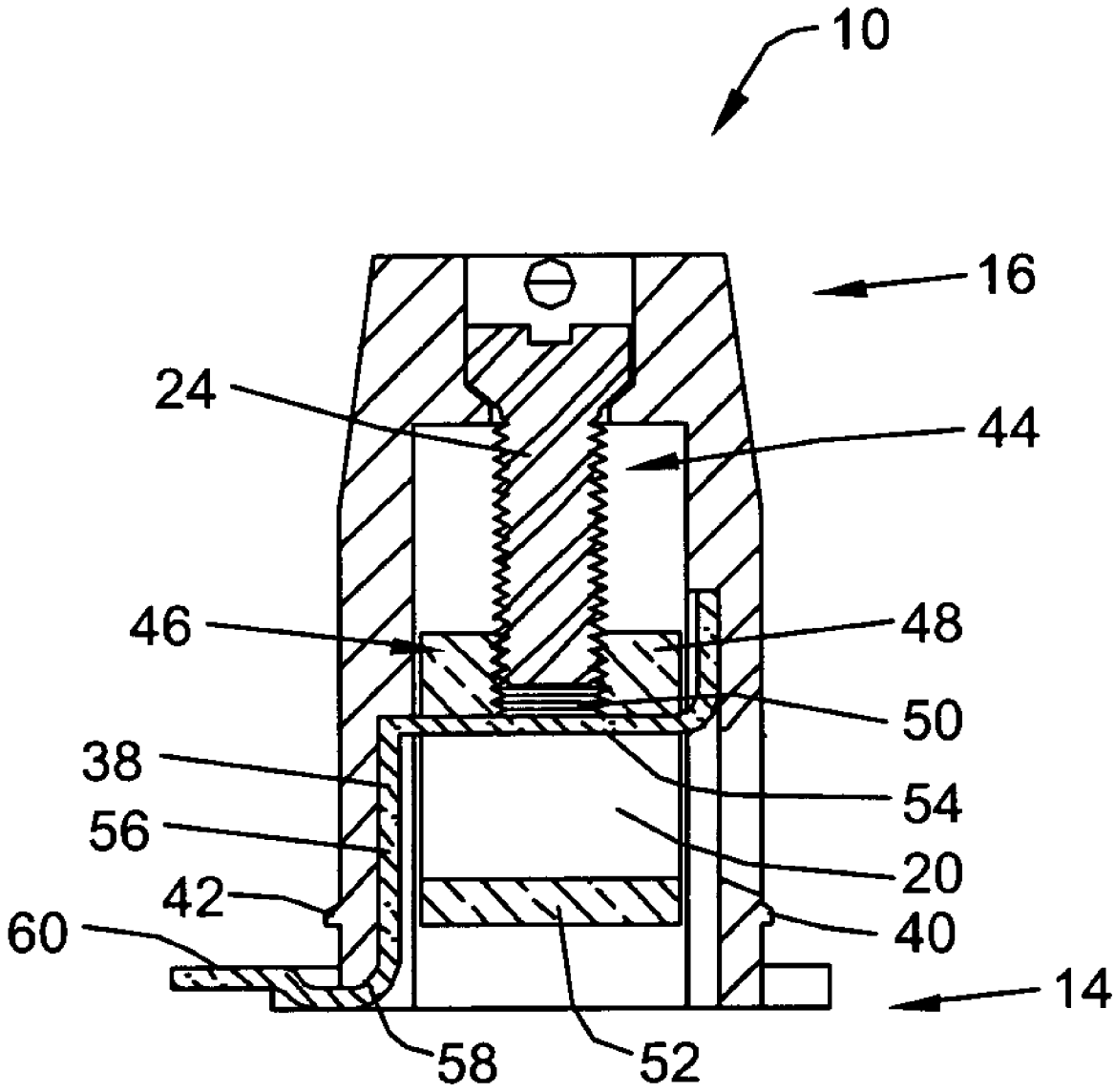
FIG. 4 is a cross-sectional view showing the terminal block along line 4—4 in FIG. 3.

FIG. 4 is a cross-sectional view showing the terminal block 10 along line 4—4 in FIG. 3. As shown in FIG. 4, the main body 12 may define an interior portion 44 configured to slidably receive a cage 46 that can be used to secure the wire or conduit to the terminal block 10 once inserted into the inlet port 20. The cage 46 can include an upper portion 48 defining an internal thread 50 adapted to threadably engage screw 24, and a lower portion 52 including a conductive layer of material (e.g. nickel plated brass) electrically coupled to the terminal lead 38. To connect the wire or conduit to the terminal block 10, the user may insert the wire or conduit into the inlet port 20 and then rotate the screw 24 in a clockwise direction, causing the cage 46 to move upwardly within the interior 44 of the main body 12. When this occurs, a horizontal section 54 of the terminal lead 38 is brought into tight contact with the wire or conduit, securing it to the terminal block 10.

As can be further seen in FIG. 4, and in the illustrative embodiment, the terminal lead 38 may project downwardly along a vertical section 56 thereof, and then bend at location 58 at or near the base portion 14 of the terminal block 10 and extend outwardly from the first side 26 of the main body 12 along an exposed section 60 thereof. The exposed section 60 of the terminal lead 38 may extend outwardly at an angle (e.g. 90°) from the main body 12, orienting the terminal lead 38 in a direction substantially parallel with the component-side surface of the printed circuit board. Although the illustrative embodiment depicted shows the horizontal and vertical sections 54,56 of the terminal lead 38 disposed within the main body 12 (e.g. by insert molding the main body 12 over a portion of the terminal lead 38), it should be understood that these sections 54,56 can also be located outside of the main body 12, if desired.

Although a Euro-style terminal block is specifically depicted in the illustrative embodiment of FIGS. 1–4, it should be understood that the terminal block 10 may assume other configurations, as desired. In certain alternative embodiments, for example, terminal block 10 may be configured similar to a barrier-type terminal block or other non Euro-style terminal block. The type of terminal block employed will depend in part on the type of connection desired as well as other design factors.

Figure 5:
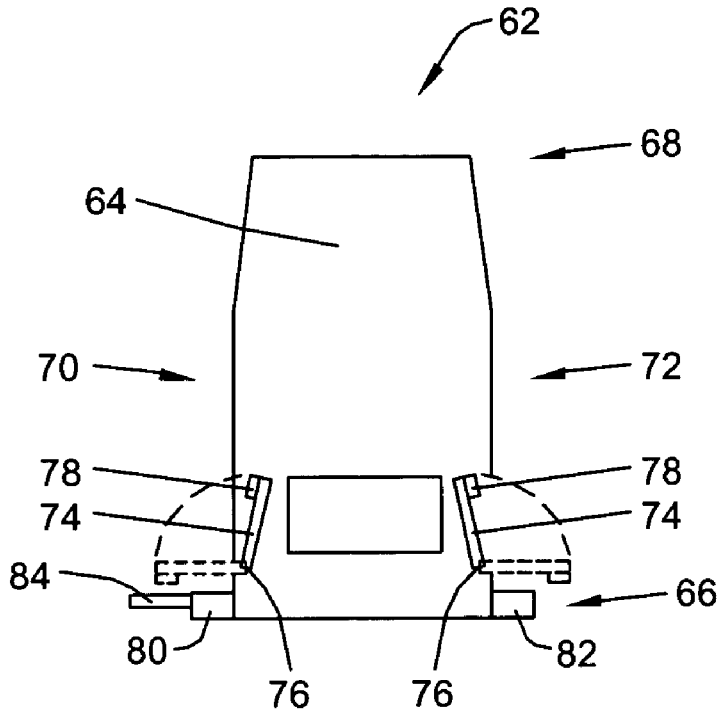
FIG. 5 is a side view of another illustrative terminal block including a number of bendable tabs.

While the illustrative embodiment of FIGS. 1–4 depict the use of several detents 40,42 to secure or support the terminal block 10 to the printed circuit board, it should be understood that other structural elements could be employed, or may be omitted, if desired. In one alternative embodiment depicted in FIG. 5, for example, a terminal block 62 in accordance with another illustrative embodiment of the present invention may include a number of bendable tabs that can be used to secure the terminal block 62 to a printed circuit board or other desired member. The terminal block 62 may include a main body 64 having a base portion 66, an upper portion 68, a first side 70, and a second side 72.

A number of bendable tabs 74 coupled to or formed integrally with the main body 12 can be configured to bend or rotate about a joint 76, as indicated generally by dashed lines. In certain embodiments, for example, the bendable tabs 74 can be configured to bend or rotate from a first (i.e. disengaged) position illustrated in FIG. 5 to a second (i.e. engaged) indicated by the dashed lines. In use, an end portion 78 of each bendable tab 74 can be configured to snap-fit within a corresponding opening formed on the printed circuit board, which in conjunction with a set of flanges 80,82, fitting nails, and/or terminal leads 84 similar to that described above with respect to FIGS. 1–4, can be used to help secure the terminal block 62 to the printed circuit board.

Figure 6:
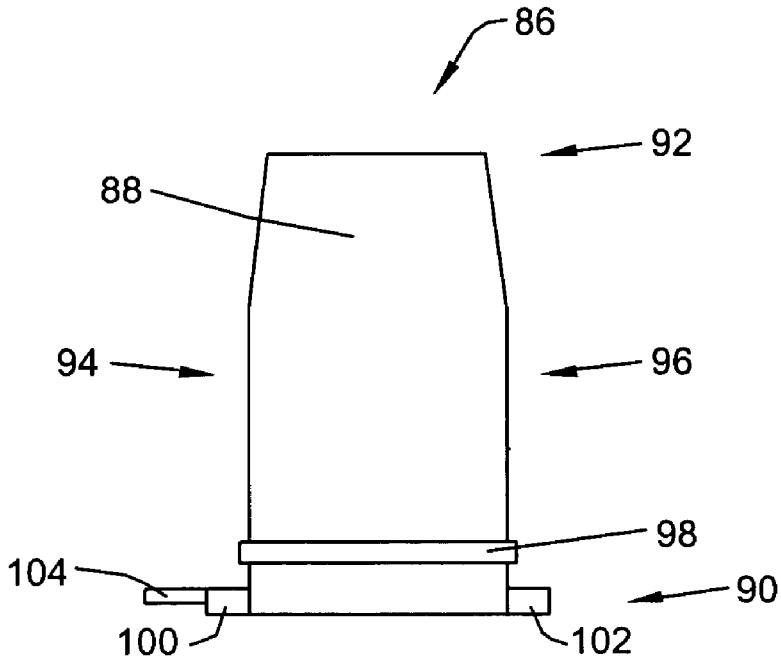
FIG. 6 is a side view of another illustrative terminal block including an expandable member.

FIG. 6 is a side view of a terminal block 86 in accordance with another illustrative embodiment of the present invention including an expandable member that can be used to secure the terminal block 86 to a printed circuit board. Terminal block 86 may include a main body 88 having a base portion 90, an upper portion 92, a first side 94, and a second side 96. An expandable member 98 coupled to the main body 88 of the terminal block 86 can be configured to act as a seal or gasket, which in conjunction with a set of flanges 100,102 and/or terminal leads 104 similar to that described above with respect to FIGS. 1–4, can be used to help secure the terminal block 86 to a printed circuit board. In some embodiments, the expandable member 98 may be formed from foam or deformable material adapted to expand or displace slightly after the terminal block 86 is passed through a terminal block opening formed in the printed circuit board. As with other embodiments herein, other structural elements such as fitting nails can be provided on the sides 94,96 and/or ends of the terminal block 86, if desired.

Figure 7:
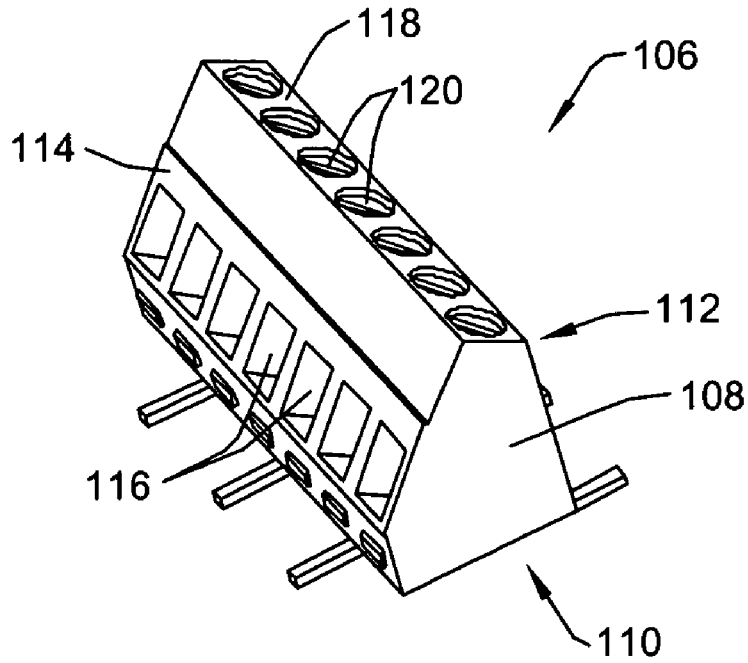
FIG. 7 is a top perspective view of a terminal block in accordance with an illustrative embodiment of the present invention having terminal leads on multiple sides of the terminal block.

FIG. 7 is a perspective view of an SMT terminal block 106 in accordance with another illustrative embodiment of the present invention having terminal leads on multiple sides of the terminal block 106. Similar to the embodiment described above with respect to FIGS. 1–4, the terminal block 106 can include a main body 108 having a base portion 110 and an upper portion 112. The main body 108 can include a terminal inlet header 114 containing a number of inlet ports 116 that can be each configured to receive a wire, conduit, jumper, shunt, or other desired member. The terminal block 106 can also include an upper header 118 equipped with a number of screws 120 or other suitable fasteners that can be used to secure the wire or conduit to the terminal block 106, if desired.

In the illustrative embodiment of FIG. 7, the terminal inlet header 114 is shown oriented at an angle to permit wire entry into the inlet ports 116 from a diagonal position. It should be understood, however, that the terminal inlet header 114 could be configured to accept wire from any number of positions, as desired. Moreover, while the terminal block 106 depicted in FIG. 7 is configured to accept wire or conduit from a single side of the terminal block 106, other embodiments have been envisioned where the terminal inlet header 114 permits wire entry from multiple sides and/or ends of the terminal block 106.

Figure 8:
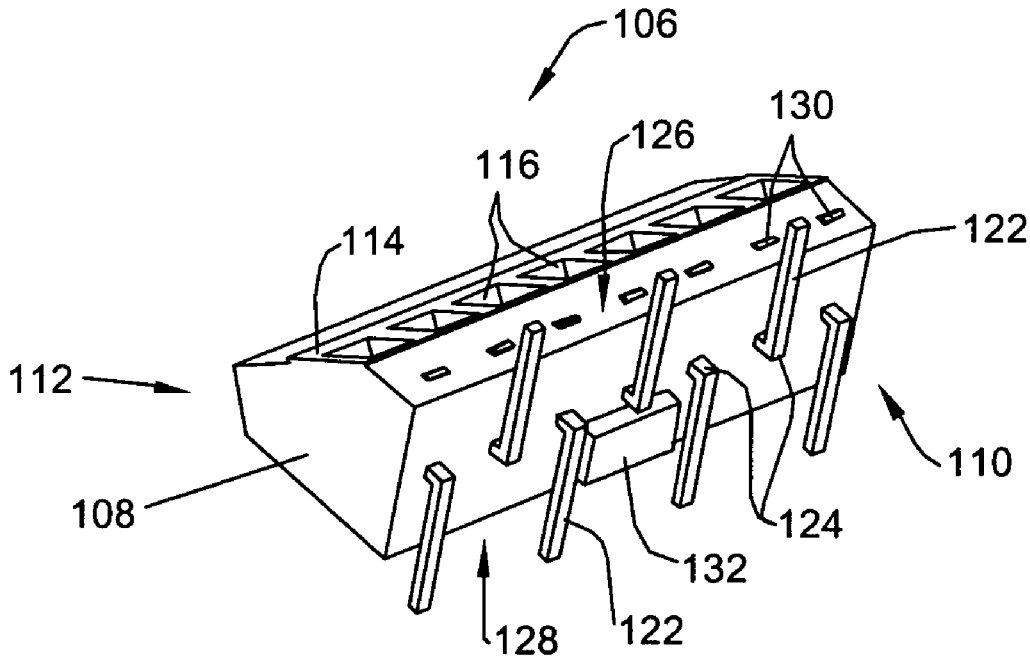
FIG. 8 is a bottom perspective view showing the base portion of the terminal block of FIG. 7.

FIG. 8 is a bottom perspective view showing the base portion 110 of the terminal block 106 of FIG. 7 in greater detail. As can be seen in FIG. 8, a number of terminal leads 122 may extend outwardly at an angle from the base portion 122 of the main body 12. As with other embodiments described herein, the terminal leads 122 can be configured to electrically connect the wires or conduit inserted into the inlet ports 116 to a number of attachment pads formed on the printed circuit board. In the illustrative embodiment of FIGS. 7–8, however, the terminal leads 122 are shown extending outwardly from the base portion 110 of the main body 108. A bending region 124 of each terminal lead 122 can be provided to orient the terminal leads 122 outwardly at an angle from the first and second sides 126,128 of the main body 108. In certain embodiments, for example, the bending regions 124 can be configured to orient the terminal leads 122 at an angle perpendicular to the first and second sides 126,128 of the main body 108, although other configurations are possible.

In use, and like above, the terminal leads 122 can be used to mechanically support the terminal block 106 to the printed circuit board in addition to electrically connecting the inlet ports 116 to the attachment pads. In certain embodiments, a number of detents 130 can also be provided to help further secure the terminal block 106 to the printed circuit board, if desired. Similar to the detents 40,42 and flanges 34,36 described above with respect to FIGS. 1–4, the detents 130 can be spaced apart from the terminal leads 122 a distance sufficient to snap-fit the base portion 110 of the terminal block 106 to the thickness of the printed circuit board, if desired.

As can be further seen in FIG. 8, the base portion 110 of the main body 108 may further include a flat placement pad 132, which can be used in conjunction with SMT automation equipment to facilitate automated attachment of the terminal block 106 to the printed circuit board. In certain embodiments, the placement pad 132 can be raised or elevated slightly above the surface of the base portion 110 to provide clearance from the terminal leads 122. In other embodiments, the placement pad 132 can be configured to lie flush with the surface of the base portion 110, if desired. In either embodiment, the placement pad 132 can be configured to permit a robotic arm to easily grip the terminal block 106 by means of suction, adhesive, or other suitable technique, allowing the terminal block to be placed on the surface of the printed circuit board in a manner similar to that of the other SMT components.

Figure 9:
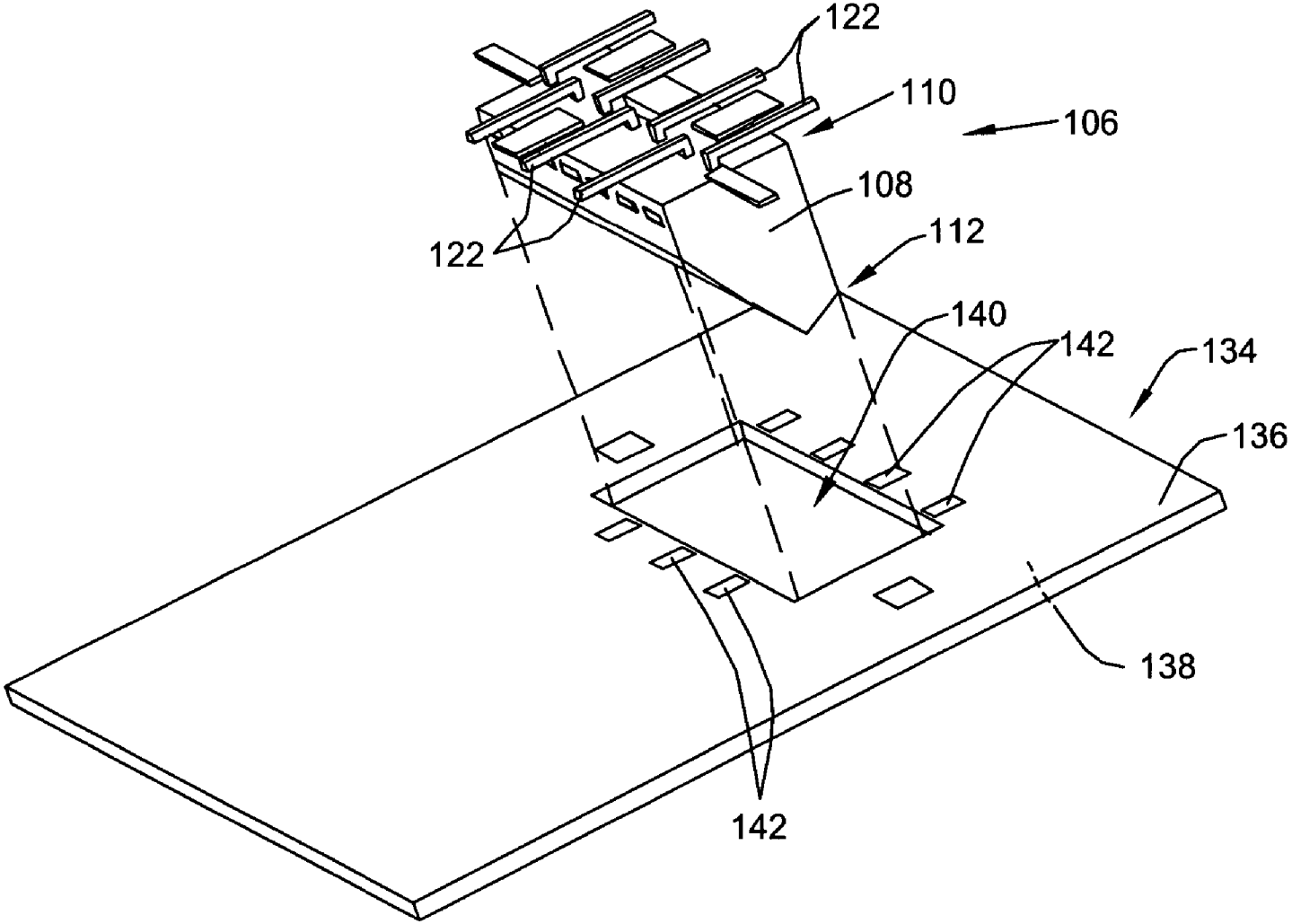
FIG. 9 is an assembly view showing the terminal block of FIGS. 7–8 prior to placement on a printed circuit board.

FIG. 9 is an assembly view showing the illustrative SMT terminal block of FIGS. 7–8 prior to placement on a printed circuit board 134. As can be seen in FIG. 9, the printed circuit board 134 can include a first side 136, a second side 138, and a terminal block opening 140 therethrough. In certain embodiments, for example, the first and second sides 136,138 can correspond, respectively to a component and non-component side of a printed circuit board, although other configurations are possible.

The first side 136 of the printed circuit board 134 can include a number of attachment pads 142 that can be used to electrically connect the terminal block 106 to conductive traces (not shown) formed on the board 134. In certain embodiments, the attachment pads 142 can correspond in location with the footprint of the terminal leads 122 to permit terminal leads 122 to make electrical contact with the attachment pads 142 during assembly. While the illustrative configuration depicted in FIG. 9 shows the attachment pads 142 formed on the first (e.g. component) side 136 of the printed circuit board 134, other embodiments have been envisioned where the attachment pads 142 are formed on the second (e.g. non-component) side 138 of the printed circuit board 134, or on a combination of both sides 136,138.

The terminal block opening 140 of the printed circuit board 134 can be dimensioned slightly larger than the base portion 110 of the terminal block 106 to permit the base portion 110 to lie flush with the thickness of the printed circuit board 134. In certain embodiments, for example, the perimeter of the terminal block opening 140 can be made slightly greater than the dimensions of the base portion 110, forming a small gap G (see FIG. 10) between the perimeter of the printed circuit board 134 and the terminal block 106 that permits the base portion 110 of the terminal block 106 to lie flush with the first side 136 of the printed circuit board 134, if desired.

Figure 10:
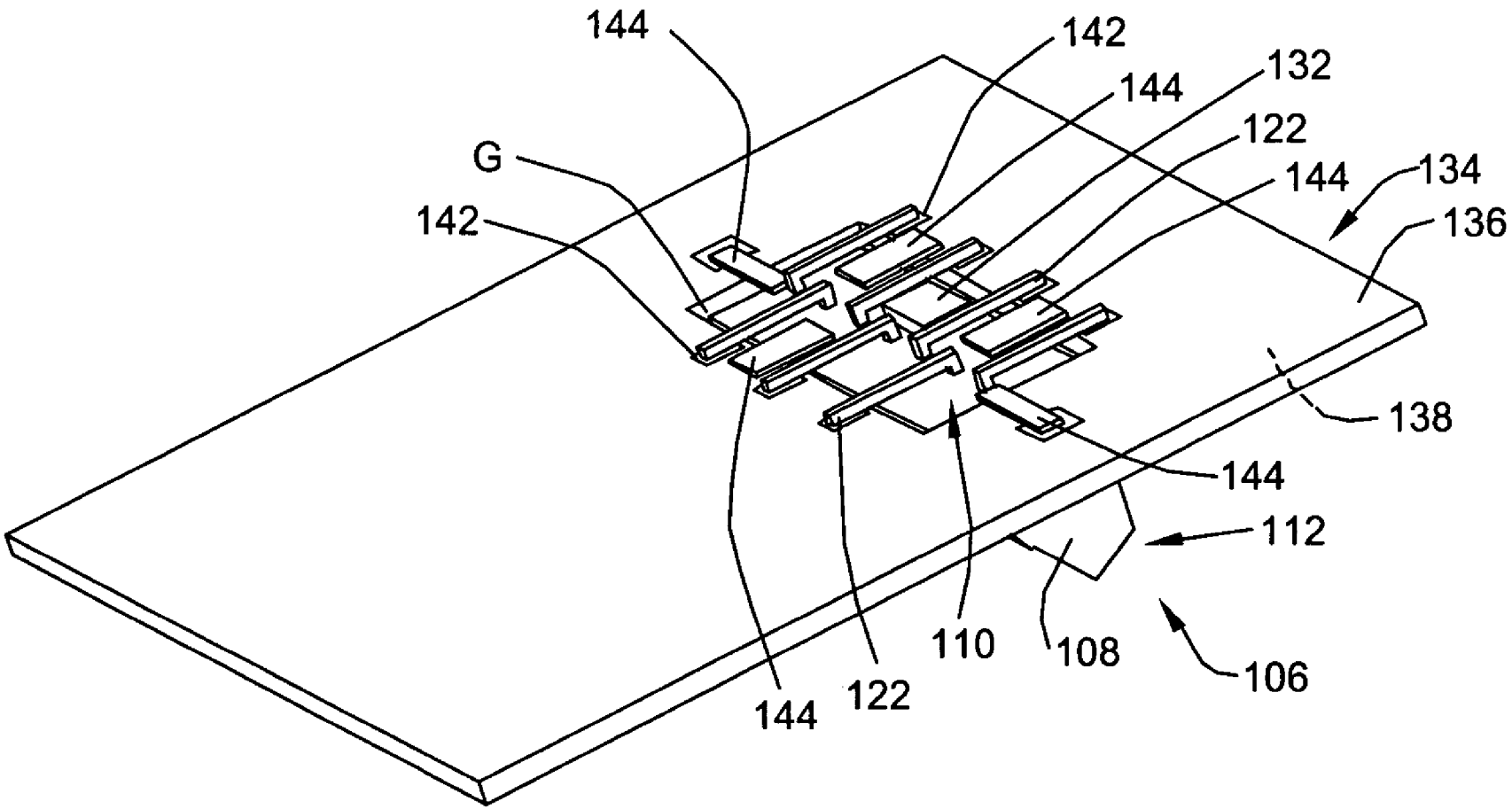
FIG. 10 is a perspective view showing the base portion of the terminal block of FIGS. 7–8 connected to the printed circuit board of FIG. 9.

FIG. 10 is a perspective view showing the base portion 110 of the terminal block 106 of FIGS. 7–8 connected to the printed circuit board 134 of FIG. 9. As shown in FIG. 10, the upper portion 112 of the terminal block 106 can be inserted through the terminal block opening 140 (see FIG. 9) and advanced until the base portion 110 of the terminal block 106 is positioned in the terminal block opening 140 of the printed circuit board 134, forming a small gap G. When the terminal block 106 is inserted and advanced in this manner, the terminal leads 122 can be configured to contact and mate with the attachment pads 142 on the printed circuit board 134, preventing further movement of the terminal block 106 through the terminal block opening 140.

Once coupled to the printed circuit board 134, the terminal leads 122 can then be soldered to the attachment pads 142 using a suitable soldering process such as reflow-soldering. In certain embodiments, the terminal leads 122 can be configured to mount to the first side 136 of the printed circuit board 134 using automated SMT techniques, allowing the terminal block 106 to be mounted concurrently with other SMT components. The ability to surface mount the terminal block 106 to the printed circuit board 134 using SMT may reduce the number of manufacturing and/or assembly steps required during fabrication. Moreover, because SMT components can be mounted with a relatively high degree of automation and precision, such techniques often result in improved quality and more consistent output than more traditional techniques such as THT or wave soldering.

In certain embodiments, the terminal block 106 may further include a number of fitting nails 144 that can be used to provide further support for the terminal block 106. The fitting nails 144 can be fixedly connected to the base portion 110 prior to assembly, and then soldered and/or adhesively connected to various soldering or other pads formed on the first side 136 of the printed circuit board 134. Alternatively, the fitting nails 144 can be formed integrally with the base portion 110 by insert molding or other suitable fabrication technique. Typically, the fitting nails 144 will be formed from a metal allowing them to be easily soldered to the printed circuit board 134, although other configurations are possible. In use, the fitting nails 144 can be used to provide additional mechanical strength to the terminal block 106 that resists torque as well as other forces exerted on the terminal block 106. In some applications, the fitting nails 144 can also be used to ground the terminal block 106 to the printed circuit board 134, if desired.

Figure 11:
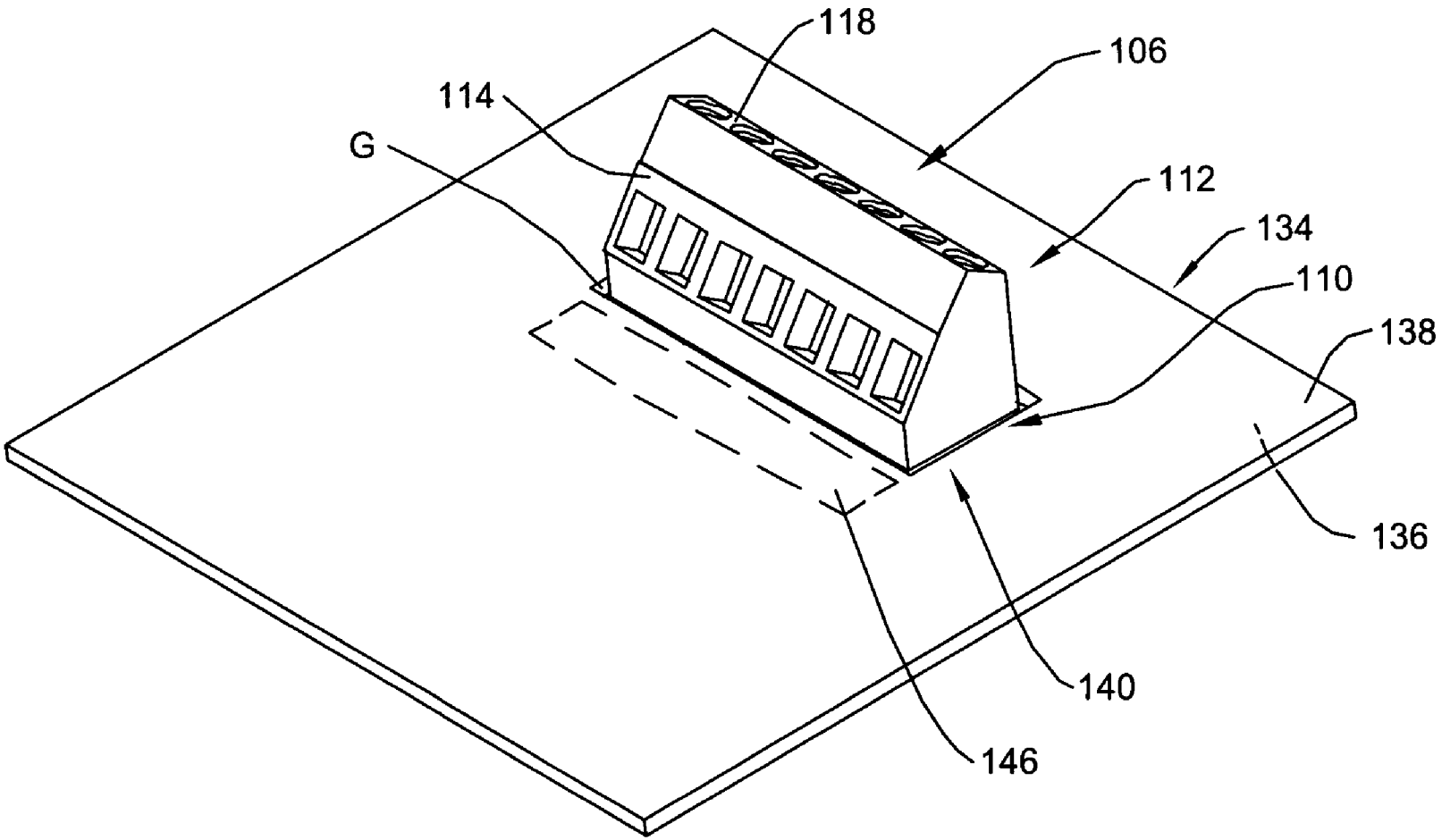
FIG. 11 is a perspective view showing the upper portion of the terminal block once attached to the printed circuit board.

FIG. 11 is a perspective view showing the upper portion 112 of the terminal block 106 once attached to the printed circuit board 134. As can be seen in FIG. 11, the upper portion 112 of the terminal block 106 can be inserted beyond the second (e.g. non-component) side 138 of the printed circuit board 134, providing access to the terminal inlet header 114 and upper header 118 from a position above the printed circuit board 134. The ability to surface mount the terminal block 106 in this manner can reduce or eliminate electrostatic discharge and/or mechanical damage to the other SMT components, which in the illustrative embodiment may be mounted on the opposite (i.e. first side 136) of the printed circuit board 134. In some cases, and as further shown in FIG. 11, the mounting of the terminal block 106 in this manner may also facilitate the screen-printing or labeling of information 146 on the second side 138 of the printed circuit board 134 immediately adjacent to the terminal block 106.

Figure 12:
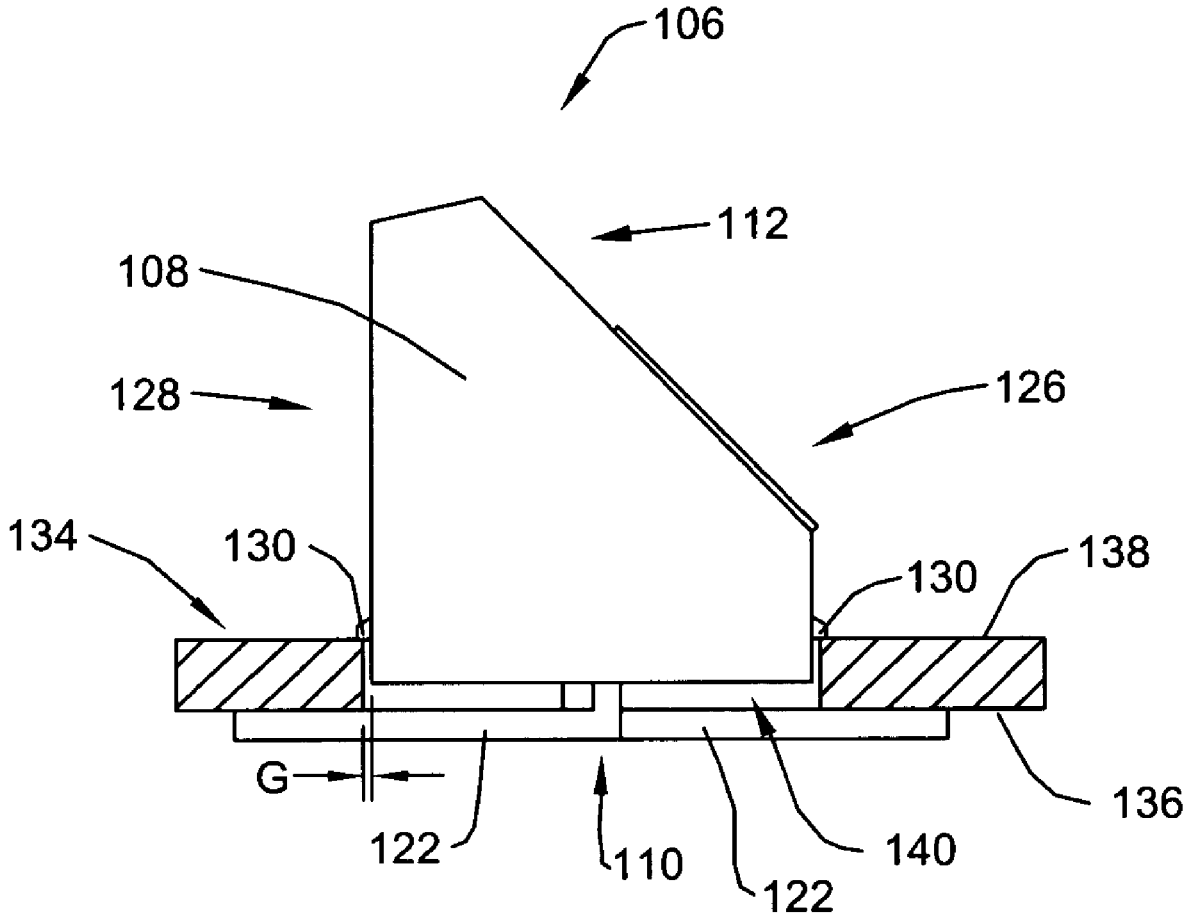
FIG. 12 is a cross-sectional view along line 12—12 in FIG. 11, showing the connection of the terminal block to the printed circuit board.

FIG. 12 is a cross-sectional view along line 12—12 in FIG. 11, showing the connection of the terminal block 106 to the printed circuit board 134 in greater detail. As can be seen in FIG. 12, the detents 130 coupled to the sides 126,128 can be configured to displace slightly and permit the upper portion 112 of the main body 108 to be inserted through the terminal block opening 140. Once the terminal leads 122 are engaged against the attachment pads (not shown), the detents can be configured to lock and secure onto the second side 138 of the printed circuit board 134, preventing the terminal block 106 from moving within the terminal block opening 140. While detents 130 are specifically depicted in FIG. 12, other suitable structural elements such as the bendable tabs 174 and expandable member 98 described above with respect to FIGS. 5–6 could also be employed, if desired.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes may be made in details, particularly in matters of shape, size and arrangement of parts without exceeding the scope of the invention.

What is claimed is:

1. A terminal block adapted for mounting on a circuit board, comprising:

a main body having a base portion, an upper portion, a first side, and a second side opposite the first side;

a first flange extending outwardly from the second side of the main body and providing a main support for the second side;

one or more terminal leads extending outwardly from only the first side of the main body at an angle offset from the main body, each terminal lead adapted to make electrical contact with a corresponding attachment pad formed on the circuit board; and a terminal block header equipped with a number of inlet ports each adapted to receive a wire or conduit.

2. The terminal block of claim 1, wherein the terminal block is an SMT terminal block.

3. The terminal block of claim 1, wherein said one or more terminal leads are adapted to support the terminal block within a terminal block opening of the circuit board.

4. The terminal block of claim 1, wherein said one or more terminal leads extend outwardly from the base portion of the main body.

5. The terminal block of claim 1, wherein said one or more terminal leads extend outwardly at an angle perpendicular to the main body.

6. The terminal block of claim 1, further comprising a second flange extending outwardly from the first side of the main body along the length of the base portion thereof.

7. The terminal block of claim 1, wherein the base portion of the main body includes a placement pad.

8. The terminal block of claim 1, further comprising means for securing the wire or conduit within the one or more inlet ports.

9. The terminal block of claim 8, wherein said means for securing the wire or conduit within the one or more inlet ports includes a screw.

10. The terminal block of claim 8, wherein said means for securing the wire or conduit within the one or more inlet ports includes a spring clamp.

11. The terminal block of claim 8, wherein said means for securing the wire or conduit within the one or more inlet ports includes a quick connect.

12. The terminal block of claim 11, wherein said quick connect is an IDC terminal.

13. The terminal block of claim 1, further comprising means for securing the main body to the circuit board.

14. The terminal block of claim 13, wherein said means for securing the main body to the circuit board includes one or more detents.

15. The terminal block of claim 13, wherein said means for securing the main body to the circuit board includes one or more bendable tabs.

16. The terminal block of claim 13, wherein said means for securing the main body to the circuit board includes an expandable member.

17. The terminal block of claim 13, wherein said means for securing the main body to the circuit board includes one or more fitting nails.

18. An SMT terminal block adapted for surface mounting on a circuit board having a component side, a non-component side, and a terminal block opening therethrough, comprising:

a main body having a base portion, an upper portion, a first side, and a second side opposite the first side;

a terminal block header including a number of inlet ports each having an adjustable opening adapted to receive a wire from a substantially horizontal position above the non-component side of the circuit board, each inlet port including a release mechanism for manually adjusting the size of the opening to selectively attach or detach the wire from the inlet port;

one or more terminal leads extending outwardly from only the first side of the main body and at an angle from the main body; and means for securing the main body to the circuit board, said means including a flange extending outwardly from the second side of the main body and providing a main support for the second side.

19. The SMT terminal block of claim 18, wherein said one or more terminal leads extend outwardly from the base portion of the main body.

20. The SMT terminal block of claim 18, wherein said one or more terminal leads extend outwardly from a single side of the main body.

21. The SMT terminal block of claim 18, wherein said one or more terminal leads extend outwardly from multiple sides of the main body.

22. The SMT terminal block of claim 18, wherein said one or more terminal leads extend outwardly at an angle perpendicular to the main body.

23. The SMT terminal block of claim 18, wherein said release mechanism includes a screw.

24. The SMT terminal block of claim 18, wherein said release mechanism includes a spring clamp.

25. The SMT terminal block of claim 18, wherein said means for securing the main body to the circuit board includes one or more detents.

26. The SMT terminal block of claim 18, wherein said means for securing the main body to the circuit board includes one or more bendable tabs.

27. The SMT terminal block of claim 18, wherein said means for securing the main body to the circuit board includes an expandable member.

28. The SMT terminal block of claim 18, wherein said means for securing the main body to the circuit board includes one or more fitting nails.

29. The SMT terminal block of claim 18, wherein the base portion of the main body includes a placement pad.

30. The SMT terminal block of claim 18, wherein said release mechanism includes a quick connect.

31. The SMT terminal block of claim 30, wherein said quick connect is an IDC terminal.

32. A system for surface mounting a terminal block to a circuit board having a component side, a non-component side, and a terminal block opening therethrough, the system comprising:

a main body having a base portion, an upper portion, a first side, and a second side, the main body located at least in part above the non-component side of the circuit board;

means for securing the terminal block to the circuit board, said means including a flange extending outwardly from the second side of the main body and providing a main support for the second side;

one or more terminal leads extending outwardly from only the first side of the main body, each terminal lead adapted to make electrical contact with a corresponding attachment pad formed on the component side of the circuit board;

a terminal block header including a number of inlet ports each adapted to receive a wire or conduit; and automation means for surface mounting the terminal block to the circuit board.

33. The system of claim 32, wherein the terminal block further includes:

means for securing the wire or conduit within the one or more inlet ports.

34. The system of claim 33, wherein said one or more terminal leads extend outwardly from the base portion of the main body.

35. The system of claim 33, wherein said one or more terminal leads extend outwardly from a single side of the main body.

36. The system of claim 33, wherein said one or more terminal leads extend outwardly from multiple sides of the main body.

37. The system of claim 33, wherein said one or more terminal leads extend outwardly at an angle perpendicular to the main body.

38. The system of claim 33, wherein the base portion of the main body is dimensioned to fit within the terminal block opening of the circuit board.

39. The system of claim 33, wherein the base portion of the main body is configured to lie flush or substantially flush with the component side of the circuit board.

40. The system of claim 33, wherein the upper portion of the main body is configured to pass through the terminal block opening of the circuit board.

41. The system of claim 32, wherein said means for securing the terminal block to the circuit board includes one or more detents.

42. The system of claim 32, wherein said means for securing the terminal block to the circuit board includes one or more bendable tabs.

43. The system of claim 32, wherein said means for securing the terminal block to the circuit board includes an expandable member.

44. The system of claim 32, wherein said means for securing the terminal block to the circuit board includes one or more fitting nails.

45. The system of claim 32, wherein the terminal block further includes a placement pad.

46. The system of claim 32, further including one or more labels disposed on the non-component side of the circuit board adjacent the terminal block opening.

47. A method of surface mounting a terminal block to a circuit board having a first side, a second side, and a terminal block opening therethrough, the method comprising the steps of:

providing a terminal block including a main body having a base portion, an upper portion, a first side, a second side opposite the first side, a flange extending outwardly from the second side of the main body and providing a main support for the second side thereof, and one or more terminal leads extending outwardly from only the first side of the main body at an angle offset from the main body;

inserting the upper portion of the main body through the terminal block opening and advancing a portion of the terminal block above the second side of the circuit board; and connecting one or more terminal leads of the terminal block to a number of attachment pads formed on the first side of the circuit board.

48. The method of claim 47, further including the step of applying a solder paste to the attachment pads prior to the step of connecting one or more terminal leads of the terminal block to a number of attachment pads formed on the first side of the circuit board.

49. The method of claim 48, wherein said step of connecting one or more terminal leads of the terminal block to a number of attachment pads formed on the first side of the circuit board includes a step of heating the solder paste.

50. A terminal block adapted for mounting on a circuit board having a component side, a non-component side, and a terminal block opening therethrough, comprising:

a main body having a base portion, an upper portion, a first side, a second side opposite the first side, a first end, and a second end opposite the first end;

a flange extending outwardly from the second side of the main body, the flange being adapted to support an intermediate portion of the main body spaced apart from said first and second ends; and one or more terminal leads extending outwardly at an angle offset from the main body, each terminal lead adapted to make electrical contact with a corresponding attachment pad formed on the component side of the circuit board.

51. A terminal block adapted for mounting on a circuit board, comprising:

a main body having a base portion, an upper portion, a first side, and a second side opposite the first side;

a first flange extending outwardly from the second side of the main body and providing a main support for the second side;

one or more terminal leads extending outwardly from only the first side of the main body at an angle offset from the main body, each terminal lead adapted to make electrical contact with a corresponding attachment pad formed on the circuit board; and wherein said one or more terminal leads are adapted to support the terminal block within a terminal block opening extending completely through the circuit board.

* * * * *